US008641243B1

(12) United States Patent
Rashidi

(10) Patent No.: US 8,641,243 B1
(45) Date of Patent: Feb. 4, 2014

(54) LED RETROFIT LUMINAIRE

(76) Inventor: Hamid Rashidi, Beverly Hills, CA (US)

( * ) Notice: Subject to any disclaimer, the term of this patent is extended or adjusted under 35 U.S.C. 154(b) by 838 days.

(21) Appl. No.: 12/804,223

(22) Filed: Jul. 16, 2010

(51) Int. Cl.
*F21V 29/00* (2006.01)

(52) U.S. Cl.
USPC . 362/373; 362/249.02; 362/294; 362/296.05; 362/311.02; 362/364; 257/98; 257/99; 257/712

(58) Field of Classification Search
USPC ..... 362/147, 249.02, 294, 296.05, 311.02, 362/364, 373; 257/98, 99, 712
See application file for complete search history.

(56) References Cited

U.S. PATENT DOCUMENTS 7,722,213 B2 * 5/2010 Inoue et al. ..... 362/241
7,722,227 B2 * 5/2010 Zhang et al. ..... 362/364
7,736,031 B1 * 6/2010 Rashidi ..... 362/364
7,959,332 B2 * 6/2011 Tickner et al. ..... 362/373
7,993,034 B2 * 8/2011 Wegner ..... 362/296.05
8,070,328 B1 * 12/2011 Knoble et al. ..... 362/311.02
8,403,541 B1 * 3/2013 Rashidi ..... 362/373
8,408,759 B1 * 4/2013 Rashidi ..... 362/373

* cited by examiner

*Primary Examiner* — Stephen F Husar
(74) *Attorney, Agent, or Firm* — Thomas I. Rozsa

(57) ABSTRACT

A retrofit light emitting diode (LED) lighting luminaire designed to have detachable and replaceable components for convenience and low cost in the luminaire maintenance including a heat dissipation member that includes detachable upper and lower sections with aligned radially extending fins, and a driver retained within the luminaire. The LED chip is retained against a surface of the lower heat dissipation member so that heat from the LED is transmitted to the radially extending fins to thereby effectively cool the LED lighting source and driver.

12 Claims, 14 Drawing Sheets

LED RETROFIT LUMINAIRE

BACKGROUND OF THE INVENTION

1. Field of the Invention

The present invention relates to the field of recessed lighting luminaires and in particular to recessed lighting luminaires which have light emitting diodes (LEDs) as the source of illumination.

2. Description of the Prior Art

With the development of semiconductor lighting devices, LED lighting sources including LED chips are in great demand in lighting luminaires used in both consumer and industrial markets. One problem with the existing LED lighting luminaires in the market and in particular with recessed lighting luminaires is that the LED lighting sources generate considerable heat. Excess heat can result in failure of the operating components of the lighting luminaires. Therefore it is necessary to incorporate a heat dissipation apparatus into the LED lighting source of each luminaire in order to achieve a reasonable usable life for the fixture.

Another problem with prior art LED lighting luminaires including the recessed lighting luminaires is that all of the components are integrated into the luminaire so if one component goes bad, the failed component can't be replaced and it is necessary to replace the entire recessed lighting luminaire. Therefore, there is a significant need for an improved recessed lighting luminaire which contains replaceable operating components so that if one component fails, only the failed component needs to be replaced and the entire lighting fixture does not need to be discarded.

Particularly, in the current market for recessed lighting luminaires having the LED lighting sources, the existing heat dissipation apparatus is manufactured as a single piece. Therefore the prior art luminaires have less efficient heat dissipation which results in reduced life of the luminaires. In addition, in prior art luminaires LED chips are permanently affixed to the apparatus. The result is that the entire apparatus must be replaced if the LED chips malfunction or otherwise fail in some manner.

Therefore there is a significant need for the recessed lighting luminaires which have an improved structure including an improved heat dissipation apparatus.

SUMMARY OF THE INVENTION

The present invention is an LED lighting luminaire including a recessed lighting luminaire utilizing an LED chip as the source of illumination, which has detachable and replaceable components for convenience and low cost in the luminaire maintenance, and improved heat dissipation means including a central recess positioned by transverse fins or veins for efficient heat dissipation.

The detachable and replaceable components of the lighting luminaire include a bottom hollow cylindrical trim ring cover, a lens, a hollow internal reflector, a heat dissipation apparatus which is a combination of lower and upper sections or members, an LED chip, a socket supporting member, a driver, an electrical connector having mated first and second members, two longitudinal supports, and a top round plate, and three spaced apart spring clips to affix the luminaire within a cannister.

The bottom hollow cylindrical trim ring cover includes interior circumferential baffles for producing an aesthetic lighting effect, an interior circumferential shelf for positioning the lens, and three spaced apart spring clips to affix the luminaire to a cannister.

The lower member of the heat dissipation apparatus includes a lower interior circumferential sidewall with a multiplicity of lower radially extending fins formed into the lower interior circumferential sidewall and extending in a radial direction outwardly from the interior circumferential sidewall. The lower radially extending fins are formed around the entire 360 degrees of the interior sidewall and are formed along their respective bottom ends onto a circumferential lower ring plate. An interior upper shelf is formed into and extends above the interior sidewall and is surrounded by the multiplicity of lower radially extending fins. The interior upper shelf surrounds an interior circular opening. Each lower radially extending fin is separated from an adjacent lower radially extending fin by a lower air gap. The lower interior circumferential sidewall surrounds an upper interior chamber. The upper member of the heat dissipation apparatus includes an upper interior circumferential sidewall with a multiplicity of upper radially extending fins formed into the upper interior circumferential sidewall and extending in a radial direction outwardly from the interior circumferential sidewall. Each upper radially extending fin is separated from an adjacent upper radially extending fin by an upper air gap. The upper interior circumferential sidewall surrounds an upper interior chamber. Connection means enables the upper and lower members to be attached to each other so that a respective upper radially extending fin is aligned with a respective lower radially extending fin and the air gaps of both member are also aligned.

An LED board having an upper surface and a lower surface is removably positioned over the interior shelf of the lower member of the heat dissipation apparatus. The lower surface includes at least one and preferably a multiplicity of LEDs which are aligned with the interior opening of the interior shelf.

A lens is retained on the interior shelf of the cylindrical trim ring cover. An interior reflector which is used to modify the beam pattern of the LEDs is positioned over the lens and retained within the interior chamber of the lower member of the heat dissipation apparatus.

A driver is removably retained within the interior chamber of the upper member of the heat dissipation apparatus and electrically connected to the LED board and to a source of power.

The socket supporting member includes the top socket affixing means for affixing a removable female socket that is transversely oriented, wherein the female socket is threaded to connect to a detachable male socket that is also transversely oriented. Therefore, the transverse orientation in connection of the sockets makes the present invention more versatile since it decreases overall height of the lighting luminaire as compared with the sockets of the existing lighting luminaires in the market that are longitudinally oriented in the electrical connection. This enables the present invention lighting luminaire to fit into shorter applications than prior art devices.

The detachable electrical connector includes first and second members that are matched to each other, wherein the first member is connected to inlet wires of the driver and the second member is connected to the male socket that matches the female socket, which is regularly positioned inside of a canister. For connecting the lighting luminaire to the ceiling electrical supply, the male socket is first connected to the female socket, and then the first and second members of the connector are connected together. Therefore, the present invention can avoid seriously twisting the inlet electrical wires to thereby prevent damage to the wires during the luminaire installation.

The present invention includes significant design improvements which are summarized as follows:

One significant improvement in the present invention is a replaceable driver (which functions as a transformer). The driver is located adjacent the top of the luminaire so that a cover can be removed to facilitate quick access to the driver. The driver can be removed and replaced. In this away, if the driver fails or otherwise malfunctions, the driver is replaced and the remainder of the luminaire is salvageable and can continue to be used.

A second significant improvement in the present invention is a replaceable male socket. In prior art recessed lighting luminaires the male socket is already built into the luminaire so if the socket fails or goes bad in a some way, it can't be replaced and the entire luminaire needs to be replaced. In the present invention, the replaceable male socket is connected to a detachable plug-in connector having first and second mating connecting members. The first connecting member is electrically connected to the diver. The second mating connector is connected to the male socket, which is in turn threaded into the female socket which in turn is electrically connected to the source of power in the structure. The first mating connecting member is connected to the driver, so that power is provided to the luminaire. Therefore, if the male socket and or connector goes bad, the mating connecting members can be separated and the male socket and its mating connector member are replaced with a new male socket and mating connector member.

A third significant improvement in the present invention is a replaceable lens. In prior art recessed lighting luminaires, the lens is not replaceable. Therefore, if the lens is cracked or incurs some other defect, it can be replaced in the present invention and the recessed lighting luminaire does not need to be discarded.

A fourth significant improvement in the present invention is that the LED chip which services as the source of illumination is replaceable. In the prior art luminaires, the LED chips are not replaceable.

A fifth significant improvement in the present invention is the inclusion of push in spring clips which retain the luminaire within a cannister.

A sixth significant improvement in the present invention is the use of an internal reflector having a surface of polished aluminum. The reflector has a special texture that reflects the light better, which produces a flood effect. Since the reflector is also replaceable, if desired a different reflector which produces a spot effect can be used. The surface of the reflector is stepped as opposed to being smooth as in the prior art. The orientation of the steps is horizontal which provides a better lighting effect than the prior art where the steps are vertically oriented or the surface is smooth. The internal reflector modifies the beam pattern of the LEDs to be wide flood, regular flood, wide spot, regular spot and narrow spot.

A seventh significant improvement in the present invention is the addition of an air cavity between the driver and LED chip. Therefore, the present invention LED lighting luminaire is much cooler and lasts much longer than the prior art luminaires. In the present invention luminaire, the driver also runs much cooler than the prior art drivers. In addition, a horizontal plate on which the driver is set is positioned higher than the horizontal veins to thereby create another air gap which supplements the cooling.

An eighth significant improvement in the present invention is to have the electrical connection of the source of power transmitted through a female socket which in the present invention can be held by a bracket of the luminaire so that the female socket is oriented transversely. In the prior art the female socket is always vertically oriented. This presents an installation problem if the area in the ceiling does not have sufficient height to accommodate the luminaire. By orienting the female socket in a transverse direction, the height requirement is reduced so that the present invention can fit in a shorter area in the ceiling. The prior art does not have this feature which has a fixed vertically oriented female socket. Therefore, the transverse female socket is held in the bracket to give it not only a more secure fitting when the detachable male socket from the fixture is threaded into the female socket which is held by the bracket, but also makes the present invention electrical connecting device more universal.

In addition, the male socket is connected to the second mating connecting member of a detachable connector having the first and second members. Therefore, the present invention can have electrical connection of the first and second members after the male socket is screwed into the female socket so that there is no twisting of the wires. In the prior art the wires are twisted and sometimes broken.

A ninth improvement in the present invention is the use of a single chip that produces white light. In the prior art, a multiplicity of chips are used to create the color effect. Therefore, in the present invention, only one chip needs to be replaced and not a multiplicity of chips.

A tenth improvement in the present invention is to design the heat dissipation apparatus including the detachable upper and lower sections or members. Therefore, it is easy to replace the LED chip if it goes bad or malfunctions, since the LED chip is removably affixed on an interior shelf of the lower member. The upper and lower heat dissipation sections can be separated so that the chip attached to the interior shelf of the lower member of the lower heat dissipation section can be easily accessed and removed and replaced.

It is therefore an object of the present invention to provide an LED lighting luminaire which is designed to have detachable and replaceable components for convenience and low cost in the luminaire maintenance.

It is also an object of the present invention to provide the detachable and replaceable components of the lighting luminaire, which include a bottom hollow cylindrical trim ring cover, a lens, a hollow internal reflector, a heat dissipation structure which includes a lower member and an upper member, an LED chip, a socket supporting member, a driver, an electrical connector having matched first and second members, two longitudinal supports, and a top round plate. Therefore, the present invention provides low maintenance costs since each component is replaceable and the entire luminaire does not have to be discarded if only one or more components need to be replaced.

It is an additional object of the present invention to provide a bottom hollow cylindrical trim ring cover, which includes interior circumferential baffles for producing an aesthetic lighting effect, an interior circumferential shelf for positioning the lens, and spring clips for affixing the lighting luminaire to a ceiling structure.

It is another object of the present invention to provide a socket supporting member which includes a top socket affixing means to affix a removable socket that is transversely oriented. Therefore, the transverse orientation in installation of the socket makes the present invention more versatile since it decreases overall height of the lighting luminaire as compared with the socket of the existing lighting luminaire in the market that is longitudinally oriented. This enables the present invention lighting luminaire to fit into shorter spaces than the prior art fixtures.

It is another object of the present invention to provide a detachable electrical connector which includes first and second members that are matched to each other, wherein the first member is connected to inlet wires of the driver and the second member is connected to a male connector that matches a socket positioned inside of a canister. For connecting the lighting luminaire to the ceiling electrical supply, the male connector is first connected to the female socket which is connected to the source of power, and then the first and second members are connected together. Therefore, the present invention will avoid seriously twisting the inlet electrical wires to thereby prevent damage of the wires during installation of the lighting luminaire.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
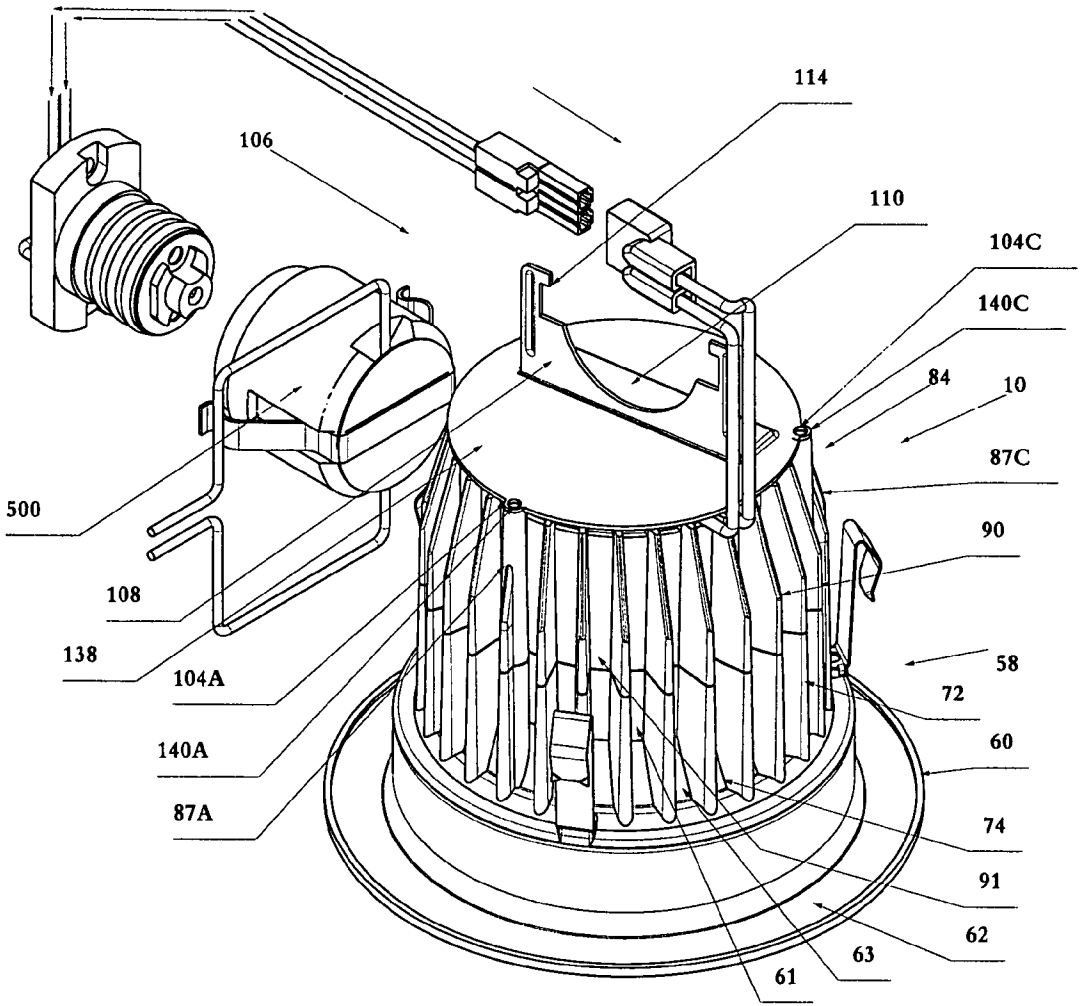
FIG. 1 is a perspective view of an LED lighting luminaire of the present invention.
Figure 2:
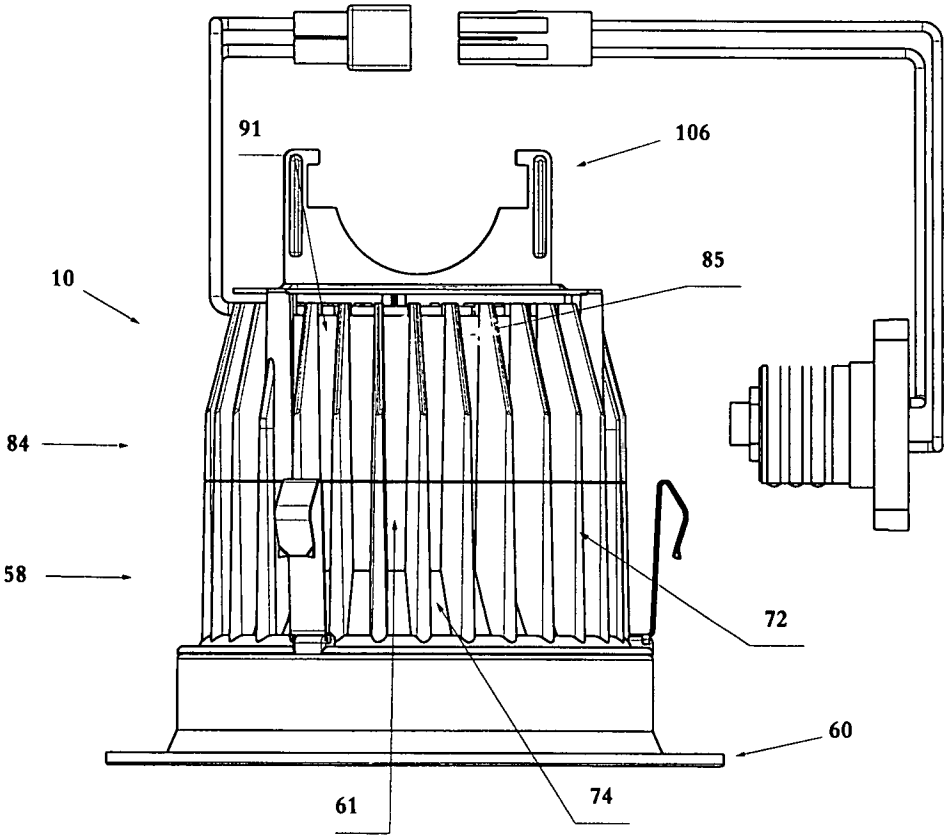
FIG. 2 is a front elevational view of the present invention LED lighting luminaire.
Figure 3:
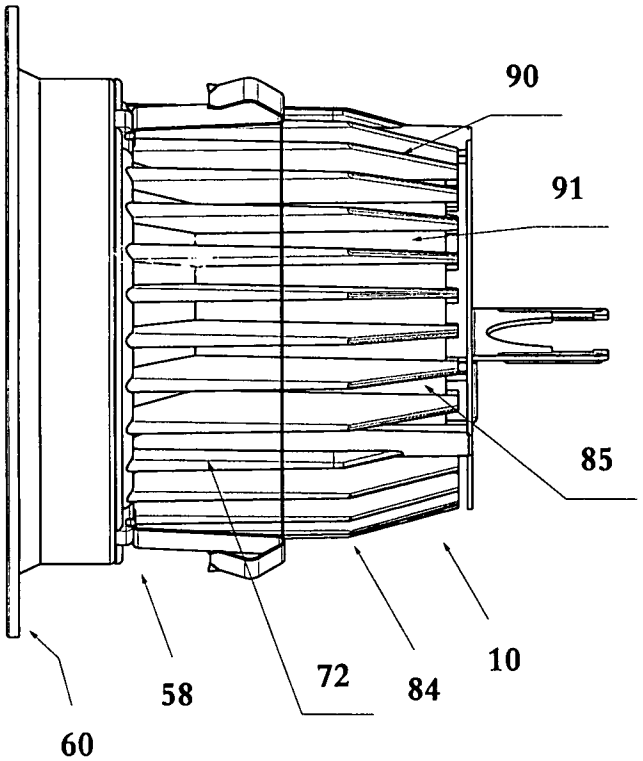
FIG. 3 is a right side elevational view of the present invention LED lighting luminaire without the male socket connector.
Figure 4:
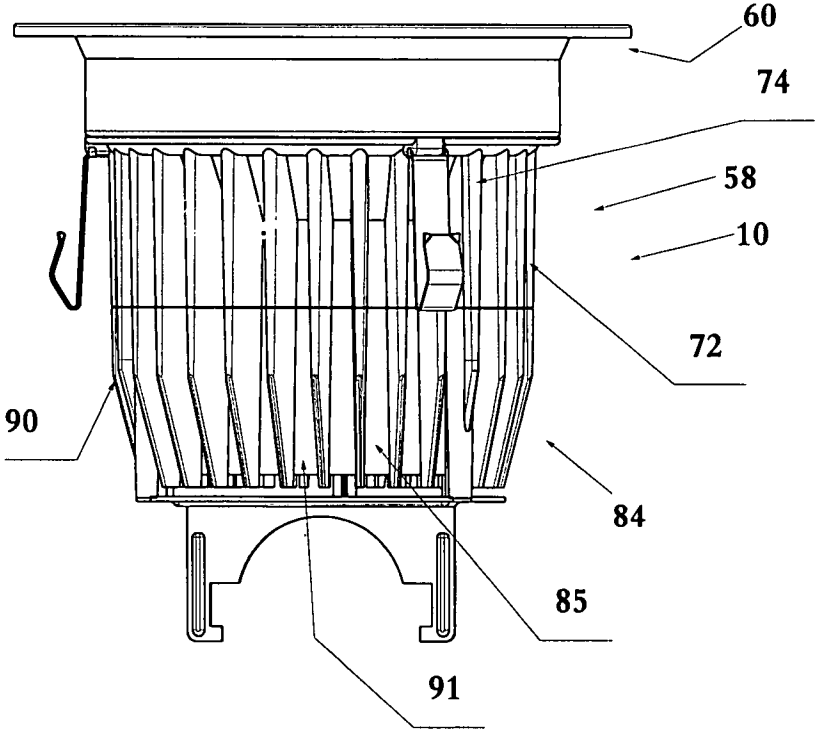
FIG. 4 is a rear elevational view of the present invention LED lighting luminaire without the male socket connector.
Figure 5:
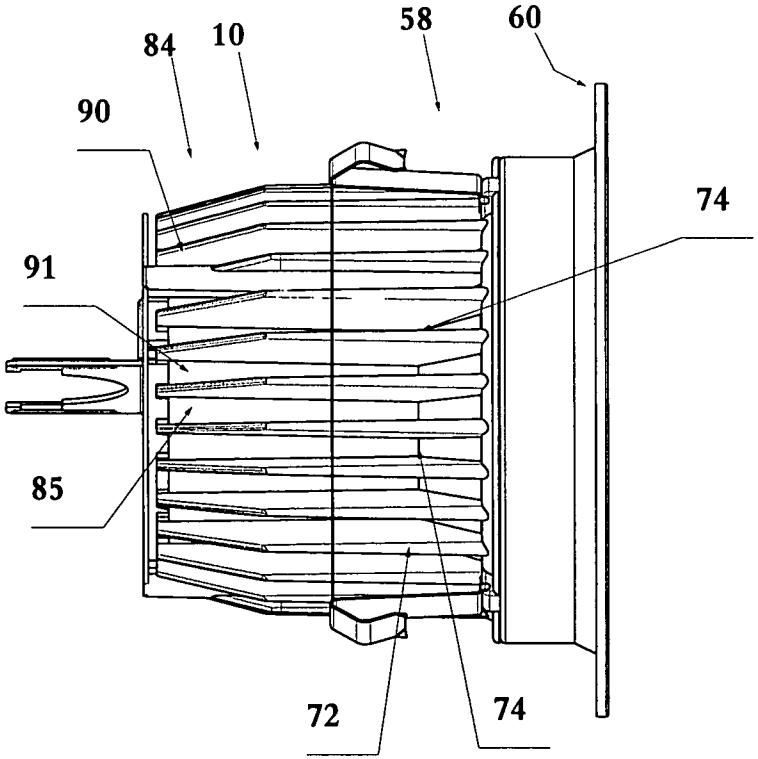
FIG. 5 is a left side elevational view of the present invention LED lighting luminaire without the male socket connector.
Figure 6:
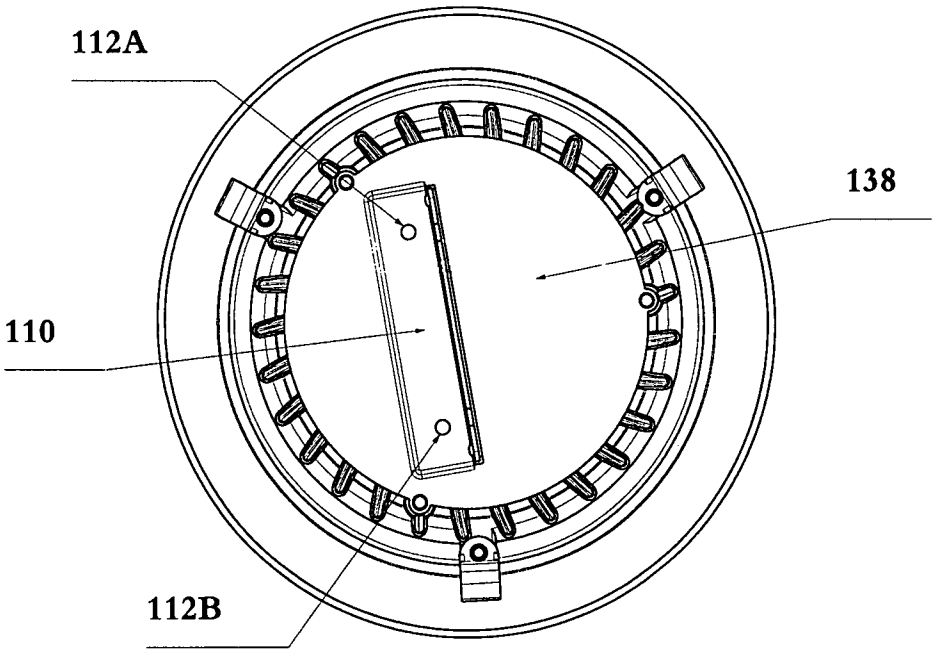
FIG. 6 is a top plan view of the present invention LED lighting luminaire.
Figure 7:
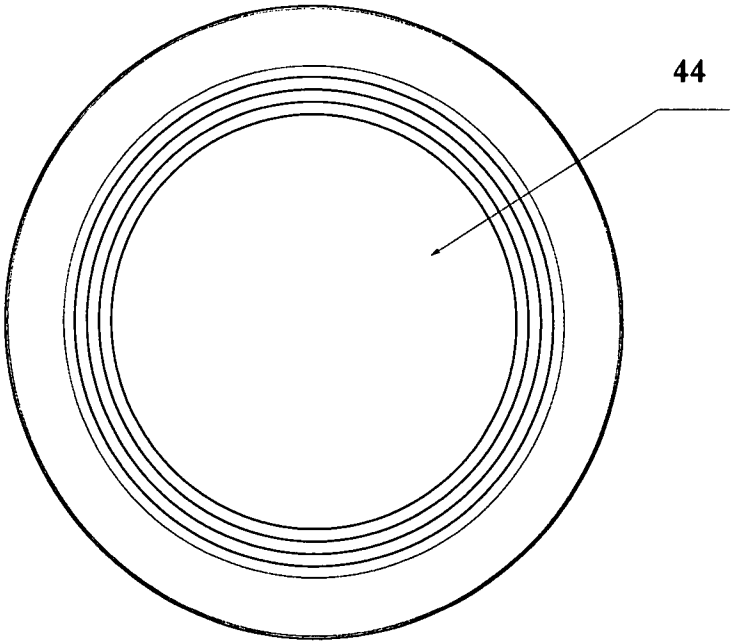
FIG. 7 is a bottom plan view of the present invention LED lighting luminaire with the lens in place.
Figure 8:
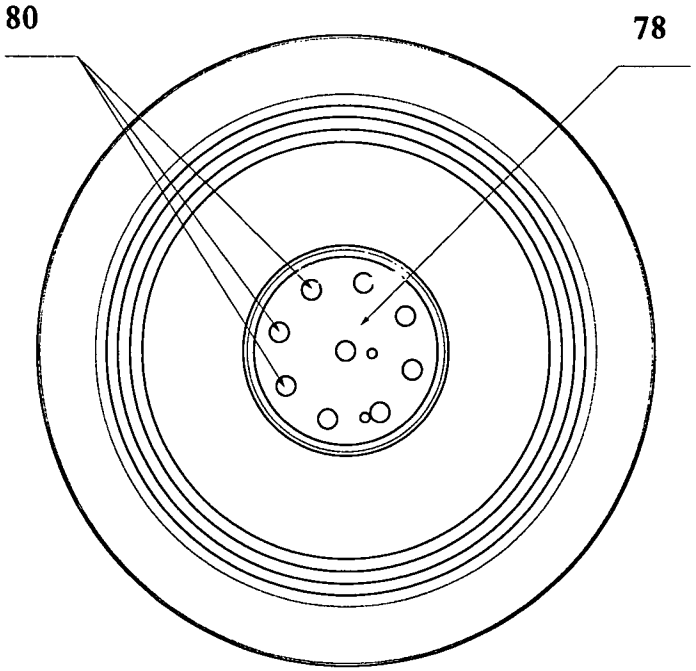
FIG. 8 is a bottom plan view of the present invention LED lighting luminaire with the lens removed to expose the LEDs.
Figure 9A:
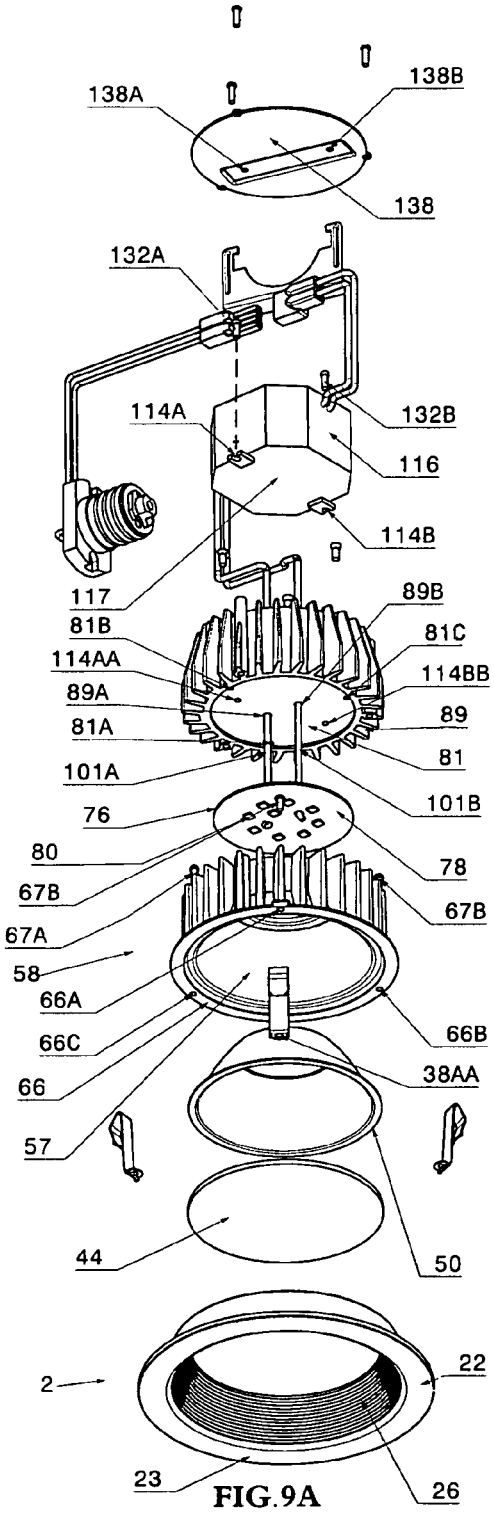
FIG. 9A is an exploded view of the present invention LED lighting luminaire viewed from a bottom perspective view.
Figure 9B:
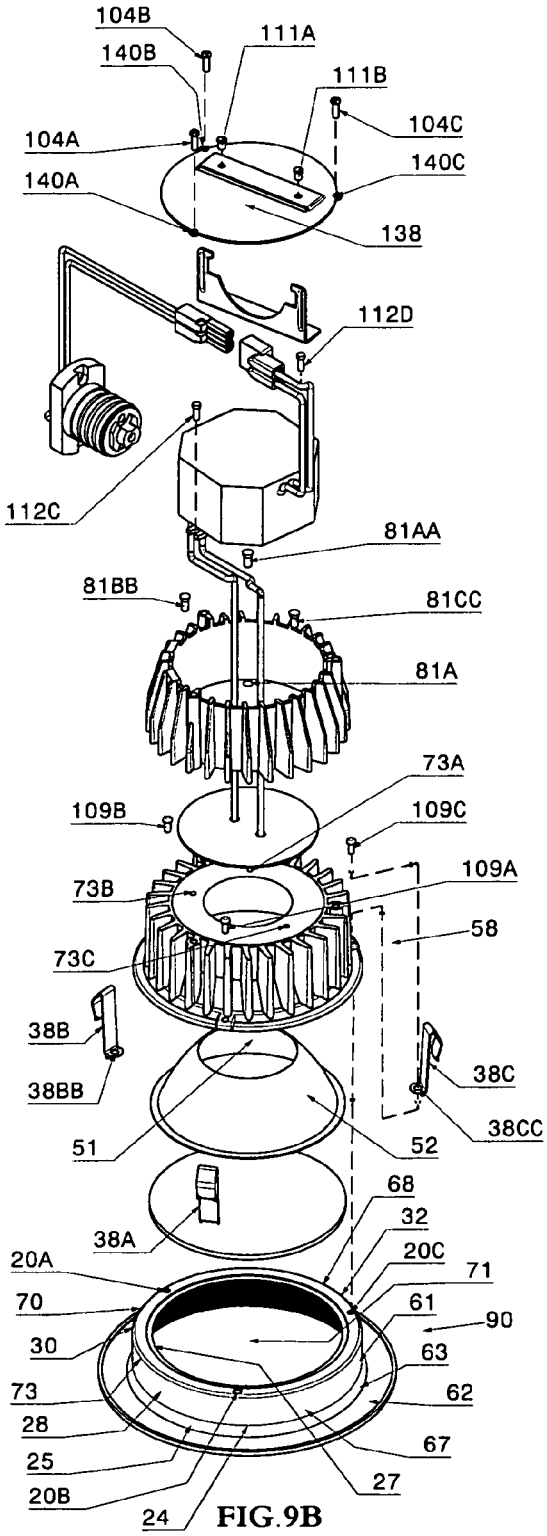
FIG. 9B is an exploded view of the present invention LED lighting luminaire viewed from a top perspective view.
Figure 10:
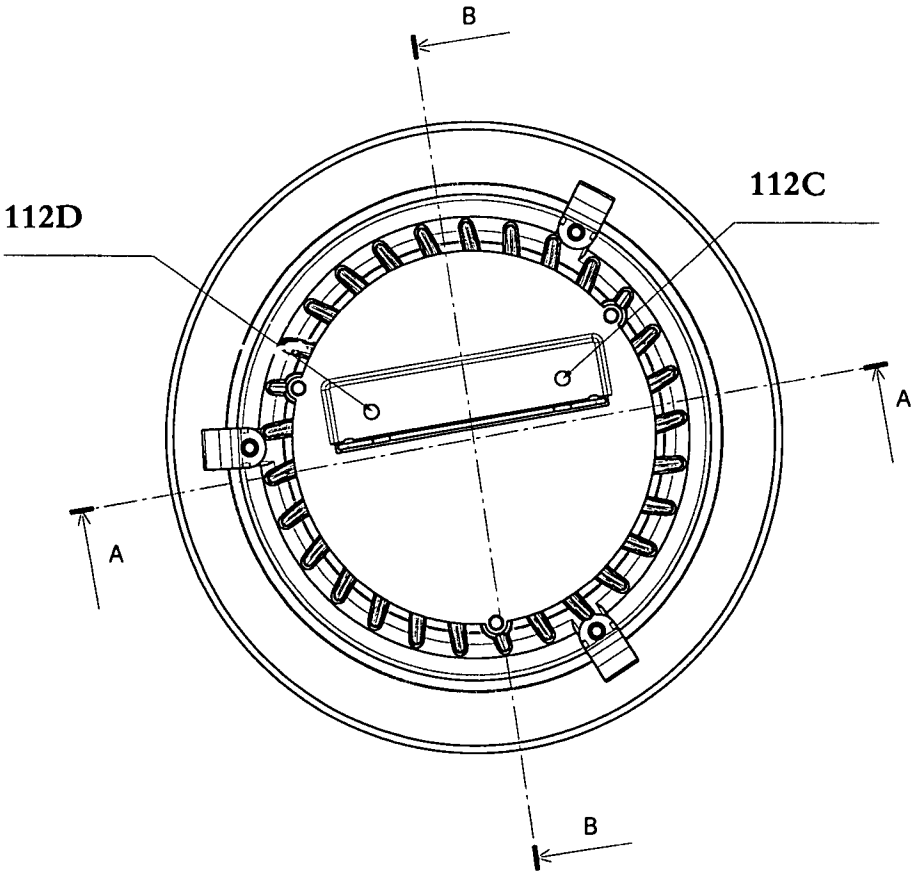
FIG. 10 is a top plan view of the present invention LED lighting luminaire with cross section lines.
Figure 11:
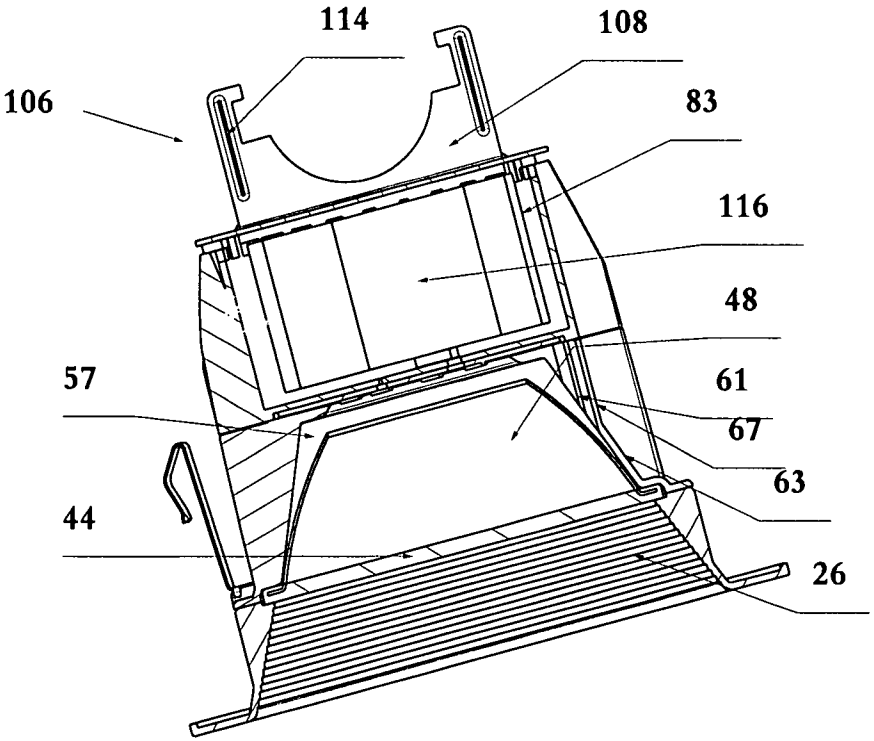
FIG. 11 is a cross-sectional view taken along line A-A of FIG. 10.
Figure 12:
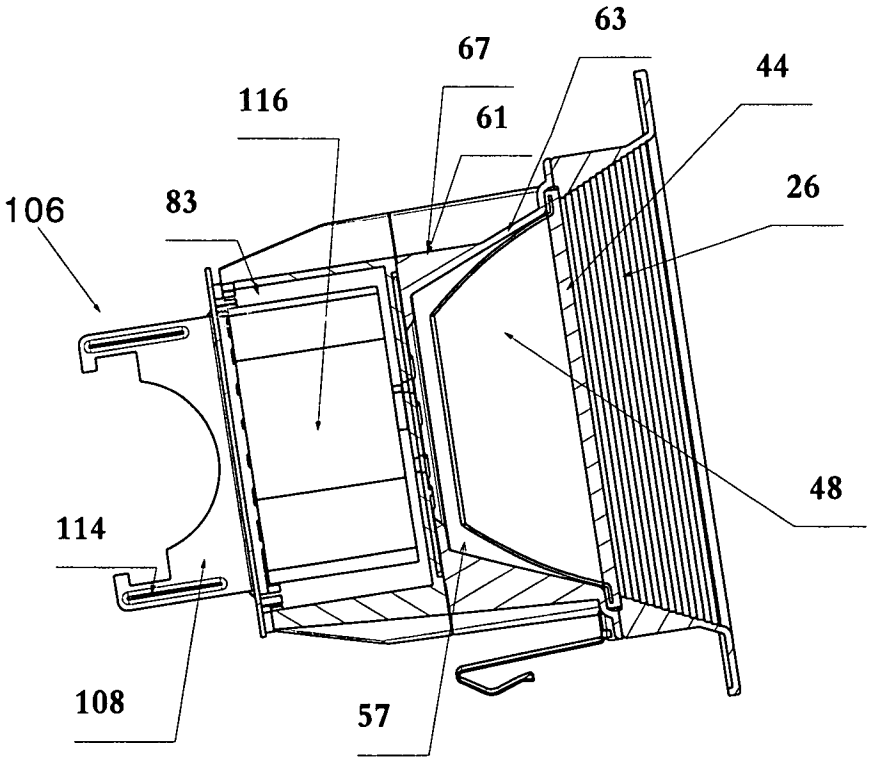
FIG. 12 is a cross-sectional view taken along line B-B of FIG. 12.
Figure 13:
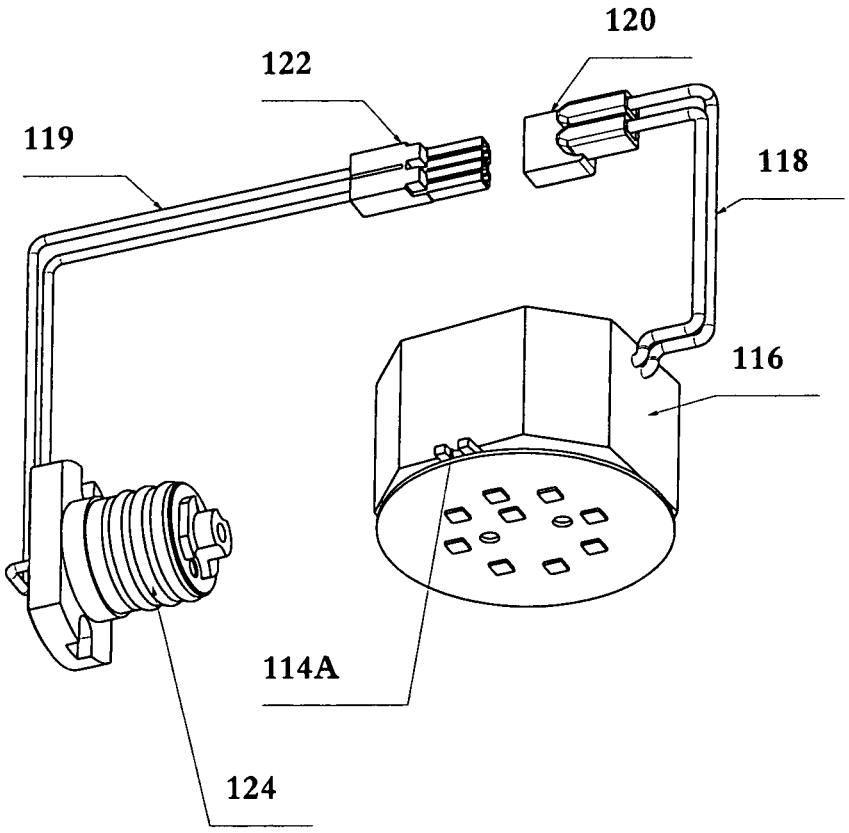
FIG. 13 is a perspective view of the LED board, driver and interconnecting members and the male socket.
Figure 14:
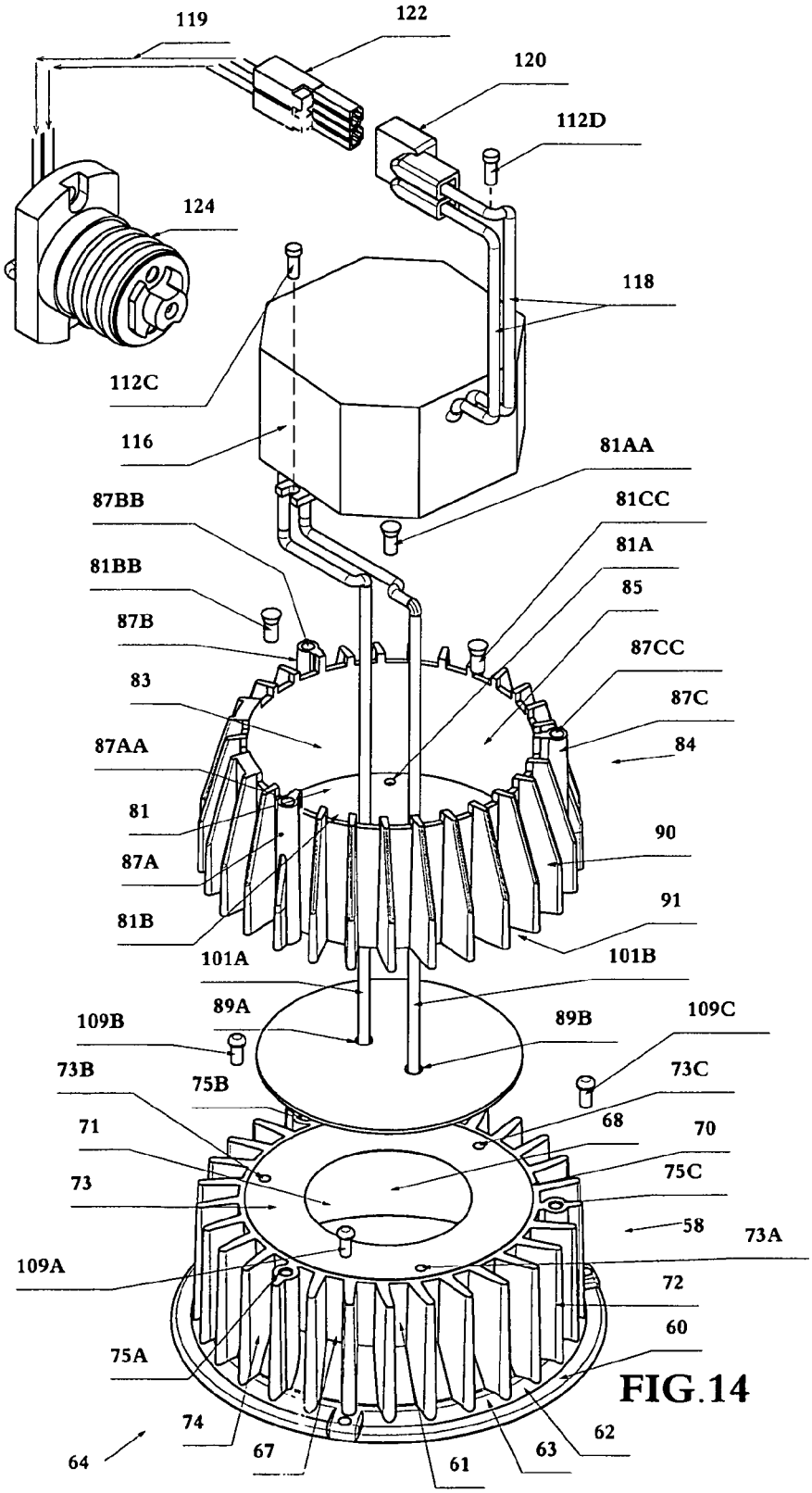
FIG. 14 is an exploded view of the upper and lower members of the heat dissipation apparatus, the LED board, the driver and the electrical connection to the male socket.

Referring to FIGS. 1 to 14, there is illustrated present invention LED retrofit luminaire 10 which is designed to have detachable and replaceable components to enable one failed component to be replaced while the remainder of the fixture is used and not discarded. The LED fixture also includes vertically oriented heat dissipation fins surrounding an interior opening to receive an LED board and a driver for improved cooling.

The width-wise diameter of the luminaire 10 is selected from the group consisting of 4 inches, 5 inches and 6 inches.

A key innovation of the present invention is the very unique heat dissipation apparatus or broadly speaking the heat dissipation means which is a significant improvement over the prior art. The heat dissipation means is comprised of a first or lower heat dissipation section 58 having a circumferential connecting ring 60 which is incorporated into a cylindrical shaped body 61 having an interior surface 68, an exterior surface 67 and a circumferential top end 70 supporting an interior shelf 73 surrounding a central opening 71. The cylindrical shaped body 61 also extends into a lower circumferential surface 63 which lies interiorly of and is attached to the upper surface 62 of the connecting ring 60.

Formed into the exterior surface 67 of the cylindrical shaped body 61 are a multiplicity of spaced apart lower longitudinal fins 72 which extend radially away from the exterior surface 67 of the first heat dissipation member body 61, and are also attached to the upper surface 62 of connecting ring 60. Each lower longitudinal fin 72 is separated from an adjacent lower longitudinal fin by a lower air gap 74. Therefore, the principal heat dissipation means of the first heat dissipation section or member 58 are the multiplicity of radially extending and spaced apart lower heat dissipation fins 72 and multiplicity of lower air gaps 74, with each respective lower longitudinal heat dissipation fin 72 separated from an adjacent lower longitudinal heat dissipation fin by a lower air gap 74.

A second or upper heat dissipation section 84 of the heat dissipation means includes a cylindrical shaped body 85 surrounding an interior chamber 83. Upper heat dissipation section 84 has a bottom wall 81 with a pair of spaced apart openings 81A and 81B. The bottom wall 81 and cylindrical shaped body 85 enclose the interior chamber 83 leaving the top open. Incorporated into the second heat dissipation section 84 are a multiplicity of spaced apart upper longitudinal heat dissipation fins 90 respectively separated by upper air gaps 91.

Upper heat dissipation section 84 is connected to the lower heat dissipated section 58 so that a respective upper longitudinal heat dissipation fin 90 is aligned with a respective lower longitudinal heat dissipation fin 72 and a respective upper air gap 91 is aligned with a respective lower air gap 74.

The second or upper heat dissipation section 84 is removably affixed to the first lower heat dissipation section 58 by connecting means such as threaded bolts or screws. By way of example, at least one and preferably a multiplicity of spaced apart affixing screws 104A, 104B, and 104C respectively extend through openings 140A, 140B and 140C in cover plate 138 and then extend through threaded openings in bosses 87A, 87B and 87C formed into the upper heat dissipation section 84 and into receiving mating openings 75A, 75B and 75C on the circumferential top 70 of the cylindrical shaped body 61 of lower heat dissipation section 58, to connect the cover plate and two heat dissipation sections together.

The two heat dissipation sections 58 and 84 are connected together so that a respective upper longitudinal heat dissipation fin 90 of the second or upper section 84 is aligned in with a respective lower longitudinal heat dissipation fin 72 of the first or lower section 58 so that the respective upper air gaps 91 of the upper section 84 are respectively aligned with the respective lower air gaps 74 of the lower section 58.

An LED chip 76 having a lower surface 78 retaining a multiplicity of LEDs 80 is press fit against interior shelf 73 of lower heat dissipation section 58 so that the LEDs 80 are aligned with opening 71. The LED chip 76 transfers heat from the LEDs 80 through the interior shelf 73 to cylindrical body 61 and through the lower longitudinal heat dissipation fins 72 and also to the body 85 of upper section 84 and to upper heat dissipation fins 90 so that heat from the LEDs 80 is effectively dissipated.

It will be appreciated that the present invention has an LED chip which has LEDs which emit white light and therefore only one chip is used with the present invention as opposed to a multiplicity of colored chips which are used in the prior art.

The driver and socket support member are illustrated in FIGS. 1, 9A, 9B, 13 and 14. The socket support member 106 is an "L" shaped structure including a transverse plate 110 which is connected to a longitudinal socket receiving plate 108. The transverse plate also includes a pair of spaced apart openings 111A and 111B which extend through the transverse plate 110 and are respectively aligned with threaded openings 138A and 138B in cover plate 138 so that fastening members such as rivets 112C and 112D are respectively affixed through the aligned openings to thereby affix the transverse plate 110 to the cover plate 138. The longitudinal socket receiving plate 108 further comprises a socket receiving bracket 114 which removably receives the female socket 500. Female socket 500 is oriented in a horizontal or transverse direction and which is electrically connected to the source of power.

The driver or transformer 116 has an oppositely disposed pair of U-shaped wings 114A and 114B affixed to the bottom surface 117 of the driver. Each wing 114A and 114B has an opening to respectively receive fastening screws 112A and 112B threaded into aligned openings 89A and 89B in bottom wall 81 of upper heat dissipation section 84. The driver 116 is removably affixed in this manner and rests within interior chamber 83 of upper heat dissipation section 84. The driver 116 receives electricity from the source of electricity connected to the electrical outlet and transmits electricity to the LED chip 76. Another significant innovation of the present invention is that the driver 116 is removable and replaceable and is within the heat dissipation section 84. The driver 116 is connected by electrical wires 118 to a second mating connecting member 120 which can be a female member. The connecting male socket 124 is connected by wires 119 to a first mating connecting member 122.

The male socket 124 is then threaded into a removable female power socket 500 held by bracket 114 along a transverse orientation, which is an option of the luminaire installation provided by the present invention. This option not only provides a much more secure hold but also makes the device more universal. This is because the male socket in the prior art is fixed along the vertical orientation, which causes a longer connection to a female socket that is also vertically oriented as compared with a shorter connection of the present invention due to to fact that both sockets are oriented along a horizontal direction.

The male socket in the present invention is removable and has a horizontal orientation. Therefore, the luminaire of the present invention provides a shorter connection than the prior art which has the male and female sockets both along a vertical orientation. The vertical distance of the present invention luminaire is decreased because the male socket is horizontally oriented instead of vertically oriented to connect to the female socket that is also horizontally oriented, wherein the female socket is connected an outlet of electricity, for example a plug of a canister positioned to a ceiling structure.

The horizontal orientation of the male socket in the luminaire installation makes the present invention luminaire more versatile because it decreases the overall height of the luminaire so even in shorter applications it will fit whereas in the prior art the vertical height may be too long. It will be appreciated that, in a situation regarding installation of the luminaire when there is a sufficient height of a ceiling structure positioned with a canister having a female socket, the removable male socket 124 can be directly connected to the female socket which is kept vertically positioned inside of the canister, instead of being removed from the canister and being positioned to the bracket 114 in the situation when the short connection is needed.

In addition, in the prior art the wires are twisted and sometimes broken when the male socket is threaded into the female socket. By having the detachable first and second connecting members 122 and 120, the present invention luminaire prevents damage of the electrical wires when connecting the male socket 124 to the female socket, which can be positioned vertically or horizontally. This is because the first and second mating connecting members will be connected after completion of connecting the male and female sockets together.

Furthermore, this mating connection also enables the driver to be removed and replaced if the driver 116 should malfunction. The driver also comprises a pair of oppositely disposed connecting wings 114A and 114B which are respectively aligned with openings 89A and 89B of lower wall 81. Fastening means 112A and 112B are respectively placed through the wings 114A and 114B and respectively threaded into openings 89A and 89B in lower wall 81 of upper heat dissipation member 84. The driver rests within chamber 83 of upper heat dissipation member 84.

The socket receiving plate 108 having bracket 114 is affixed to the cover plate 138 as previously described to extend above the plate so that the female power socket can be clipped to the bracket and male connecting socket 124 threaded into the female power socket as described above. Fastening means 104A, 104B and 104C extend through respective openings 140A, 140B and 140C in the cover plate 138 and fasten the plate into respective threaded openings 87AA, 87BB and 87CC of respective bosses 87A, 87B and 87C formed into the cylindrical wall 85 of upper heat dissipation member 84. This design is a significant improvement in the present invention. Since the driver 116 is located adjacent the top cover 138, the driver 116 can be quickly replaced by removing the top cover 138 and disconnecting and replacing the driver 116.

Upper heat sink 84 is removably affixed to lower heat sink 58 by respective fastening screws 81AA, 81BB and 81CC respectively extending through openings 81A, 81B and 81C in lower wall 81 of upper heat sink 84 and then respectively threaded into threaded openings 73A, 73B and 73C in interior shelf 73 of lower heat sink 58. Openings 75A, 75B and 75C are not used.

An extremely important innovation in the present invention is a significant improvement in air circulation around the driver 116 positioned within upper heat dissipation member 84. The driver 116 is within the luminaire (in the prior art the driver is outside of the luminaire) and is cooled by the heat dissipation fins 90 of the upper heat dissipation member 84. The LED chip is positioned to rest over interior shelf 73 of lower heat dissipation section 58 as previously described.

Therefore, the driver and LED chip run much cooler than the respective prior art driver and LED lighting sources and therefore they last much longer.

The bottom wall 81 also has openings 89A and 89B to permits connecting wires 101A and 101B to electrically connect the LED chip 76 to the driver 116.

As further illustrated, the lighting luminaire 10 further comprised of a bottom hollow cylindrical trim ring cover 90, a lens 44, and a hollow internal reflector 48.

The bottom hollow cylindrical trim ring cover 90 is comprised of a bottom transverse ring 22 having a bottom exterior surface 23. The ring 22 at its inner circumference is connected to a hollow circular section 24 having a frustum shaped exterior surface 25 and interior surface. On the interior surface, there are a plurality of transverse circumferential baffles or grooves 26 for producing an aesthetic light effect when the lighting luminaire is in use. The hollow frustum shaped section 24 in turn is connected to a cylindrical wall 28 having an exterior surface 30, an interior surface and a circular top 32. It will be appreciated that a plurality of threaded holes 20A, 20B, and 20C are positioned on the top 32 of the wall for assembling the lighting luminaire, and an inner circumference shelf 27 is positioned on the interior surface of the wall for positioning the lens 44.

Lower heat sink 58 has a connecting ring 60 with three spaced apart openings 66A, 66B and 66C. In addition, three spring clips 38A, 38B and 38C are positioned 120 degrees apart. Each spring clip 38A, 38B and 38C has a respective transverse opening 38AA, 38BB and 38CC. The spring clips are fastened to the lower heat sink 58 and to cylindrical ring cover 90 by a respective fastening screw 109A, 109B and 109C respectively extending through a spring clip opening 38A, 38B and 38C and respective openings 66A, 66B and 66C in the connecting ring of the lower heat sink 58 and respectively threaded into a threaded opening 20A, 20B and 20C in the cylindrical trim ring cover 90.

With the aid of the spring clips, the lighting luminaire 10 can be positioned onto an upper position of a lighting cannister when the spring clips 38A, 38B and 38C are affixed to the respective attachment means such as hooks within a canister that is affixed to the building structure. Therefore, the spring clips hold the lighting luminaire 10 in the cannister.

The lens 44 of the present invention is round in shape and replaceable. The lens can be transparent, frosted or translucent according to a design of the expected lighting effect.

The hollow internal reflector 48 is comprised of a bottom rim 50 and a top dome 52, which can be made of various materials and have various types of interior texture based on a design of the expected lighting effect. For example, the reflector can be made of polished aluminum having a smooth interior surface, which is incorporated with a transparent lens for achieving an intensive lighting effect. The interior surface 46 can be modified to cause the beam pattern from the LEDs 80 to be wide flood, regular flood, narrow spot, regular spot and wide spot. The internal reflector 48 has top opening 51 which is aligned with the LEDs 80. The internal reflector 48 is press fit retained to rest on the lens 44 which in turn rests on inner circumferential shelf 27 of the trim ring cover 90 and within interior chamber 57 of lower heat dissipation member 58. Top opening 51 of internal reflector 48 is aligned with the LEDs 80.

As previously discussed, the heat dissipation means of the present invention is a detachable structure including a lower or first heat dissipation member or section 58 and an upper or second heat dissipation member or section 84 which are mated together as previously discussed. This makes replacement of the LED chip possible since it is removably attached on the interior shelf 73 of lower heat dissipation member 58.

When assembling the present invention lighting luminaire 10, the lens 44 is positioned on the interior circumferential shelf 27 of the bottom hollow cylindrical trim ring cover 90. The hollow internal reflector 48 is then positioned, wherein the rim 50 of the reflector presses against the lens 44 so that the trim ring cover 90 and internal reflector 48 are concentrically aligned together. The lower heat dissipation section 58 is affixed to the trim ring cover, where the bottom exterior surface 66 of the transverse ring 60 connects to the top 32 of the cylindrical wall 28 of the trim ring cover 90 by the fastening means extending through the spring clips as previously described.

The cover 138 and upper heat dissipation section 84 are connected together by screws 104A, 104B and 104C respectively extending through cover openings 140A, 140B and 140C through respective threaded openings 87AA, 87BB and 87CC of connecting bosses 87A, 87B and 87C of the upper heat dissipation section 84.

The top dome 52 of the internal reflector 48 is within chamber 57 of lower heat dissipation section 58 so that illumination emitted by the LEDs 80 is surrounded by the reflector to generate an enhanced lighting effect. In addition, the longitudinal veins or fins 72 are aligned with the respective fins 90 of the upper heat dissipation member 84.

The driver 116 is then affixed as previously described and the top cover is affixed as previously described.

The present invention lighting luminaire 10 has many unique structural features that provide user-friendly properties and are more convenient in the luminaire maintenance.

Referring to the above illustration of the structural components and procedures to assemble the lighting fixture, it is evident that the present invention lighting luminaire possesses the features of the detachable components which are replaceable, such as the detachable heat dissipation means having the respective upper and lower sections 84 and 58, and the detachable LED chip. Such characteristics provides more convenience in service especially in repairing the luminaire. This provides a significant benefit over the existing lighting luminaires in the market which have heat dissipation apparatus that are the non-detachable single units and LED chips that are non-replaceable. The present invention also brings a low cost in maintenance of the lighting luminaire since each component is replaceable if it malfunctions.

It will be additionally appreciated that the present invention design includes the detachable electrical connector. Therefore for connecting the lighting luminaire to the ceiling electricity supply, a user can first complete the connection of the male connector 124 to a female socket 500 positioned inside of a canister which is positioned on the ceiling, and then connect the first member 120 to the second member 122 of the detachable electrical connector for completion of the wire connection. The result is that serious twisting of the inlet electricity wires 118 and 119, which occurs in the installation of the existing lighting fixture, can be avoided to thereby prevent damage of the electrical wires.

It will be further appreciated that the present invention provides the socket supporting member 106 having the top socket affixing means, which can affix a removable female socket that is transversely oriented. Therefore, the transverse orientation in installation of the female socket makes the present invention more versatile. This is because it decreases overall height of the lighting luminaire in installation as compared with the socket being longitudinally oriented. Therefore, the present invention will fit even in shorter applications. Such advantage of versatility is compared with the existing lighting luminaires, wherein its longitudinal height in installation may be too long to fit all conditions of the ceiling structure.

It will be additionally appreciated that the present invention provides the transverse circumferential baffles on the interior surface of the bottom ring cover, which are able to produce aesthetic lighting effect when the lighting luminaire is in use. This is advantageous, as compared with a smooth interior surface or the longitudinal steps on the interior surface of the existing lighting luminaires in the market which produce the lighting effect that is less attractive.

In addition, the present invention lighting luminaire uses a single LED chip, as compared with multiple chips employed in the existing lighting luminaire, which provides simplicity in use and maintenance of the lighting fixture.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A luminaire to be used in conjunction with a housing retaining a female threaded socket electrically connected to a source of power, comprising:

a. a bottom hollow trim ring cover including a trim ring and a hollow cylindrical wall having a top surface and an interior circumferential shelf adjacent the top surface, and means to retain the trim ring cover within a housing in a ceiling fixture;

b. a removable and replaceable lens resting on the interior shelf of the hollow cylindrical wall of the trim ring cover and a removable and replaceable interior reflector having an exterior surface terminating in a top having a central opening leading to an interior surface, and a lower rim which rests on said lens;

c. a removable and replaceable a heat dissipation apparatus including detachable lower and upper sections, (i) said lower section having a circumferential connecting ring incorporated into a cylindrical shaped hollow body having an interior surface, an exterior surface and a circumferential top end surrounding and interior shelf which in turn surrounds a central opening, said cylindrical shaped hollow body extending into a lower circumferential surface which lies interiorly of and is attached to an upper surface of the connecting ring, a multiplicity of spaced apart lower longitudinal fins attached to and extending circumferentially around and radially away from said exterior surface of the cylindrical shaped body and also are attached to the lower circumferential surface, each longitudinal fin being separated from an adjacent longitudinal fin by an air gap, an LED chip removably retained against said interior shelf, (ii) said upper section including a circumferential wall and a bottom wall which partially enclose an interior chamber, a multiplicity of spaced apart upper longitudinal heat dissipation fins respectively separated by air gaps, the upper longitudinal heat dissipation fins extending circumferentially around and connected to the circumferential wall, (iii) the LED chip electrically connected to a driver, the lower and upper sections connected together so that a respective lower longitudinal fin of the lower section is respectively aligned with an upper longitudinal fin of the upper section, and the LED chip faces into the interior of the lower section and can illuminate through the top opening in the internal reflector;

d. an "L" shaped socket supporting member including top socket affixing means and a bottom transverse plate which is affixed to a cover plate which in turn is affixed to the upper section;

e. a detachable electrical connector including first and second mating connecting members that are matched each other, wherein the second mating connector member is connected by electrical wires to a removable and replaceable male connecting socket and the first mating connecting member is connected by electrical wires to a removable and replaceable driver;

f. the driver affixed to the bottom wall of the upper section and resting within the interior chamber of the upper section; and g. the multiplicity of upper and lower longitudinal fins and air gaps enabling heat from the LED chip to be dissipated into a ceiling fixture to enable the driver to run at reduced temperatures.

2. The luminaire in accordance with claim 1 wherein the interior wall of the cylindrical trim ring cover has interior transverse baffles.

3. The luminaire in accordance with claim 1 wherein the means to retain the trim ring cover within a housing of a ceiling fixture are a multiplicity of spring clips affixed to the trim ring cover.

4. The luminaire in accordance with claim 1 wherein the LED chip is a single chip which delivers white light.

5. The luminaire in accordance with claim 1 wherein the LED chip is a single chip board which delivers white light.

6. A luminaire to be used in conjunction with a housing retaining a female threaded socket electrically connected to a source of power, comprising:

a. a bottom hollow trim ring cover including means to retain the trim ring cover within a housing in a ceiling fixture;

b. a removable and replaceable lens retained within the trim ring cover and an internal reflector resting over the lens;

c. a heat dissipation apparatus including detachable lower and upper sections, (i) said lower section having a hollow body having an interior surface, an exterior surface and a circumferential top end surrounding a central opening, a multiplicity of spaced apart longitudinal fins attached to and extending circumferentially around and radially away from said exterior surface of the body, each longitudinal fin being separated from an adjacent longitudinal fin by an air gap, (ii) said upper section including a circumferential wall and a bottom wall which partially enclose an interior chamber, a multiplicity of spaced apart upper longitudinal heat dissipation fins respectively separated by air gaps, the upper longitudinal heat dissipation fins extending circumferentially around and connected to the circumferential wall, (iii) the LED chip electrically connected to a driver, the lower and upper sections connected together so that a respective lower longitudinal fin of the lower section is respectively aligned with an upper longitudinal fin of the upper section, and the LED chip faces into the interior of the lower section and can illuminate through the top opening in the internal reflector which modifies the illumination pattern from the LEDs;

d. a socket supporting member is affixed to a cover plate which in turn is affixed to the upper section;

e. a detachable electrical connector including first and second mating connecting members that are matched each other, wherein the second mating connector member is connected by electrical wires to a removable and replaceable male connecting socket and the first mating connecting member is connected by electrical wires to a removable and replaceable driver;

f. the driver retained in the luminaire so that it rests within the interior chamber of the upper section; and g. the multiplicity of upper and lower longitudinal fins and air gaps enabling heat from the LED chip to be dissipated into a ceiling fixture to enable the driver to run at reduced temperatures.

7. The luminaire in accordance with claim 6 further comprising a replaceable trim ring cover.

8. The luminaire in accordance with claim 6 further comprising a replaceable LED chip.

9. The luminaire in accordance with claim 6 further comprising a replaceable male socket.

10. The luminaire in accordance with claim 6 further comprising a replaceable lens.

11. The luminaire in accordance with claim 6 further comprising a replaceable heat dissipation apparatus.

12. The luminaire in accordance with claim 10 further comprising the LED chip is a single chip which delivers white light.

* * * * *